US009815183B2

(12) United States Patent
Wang

(10) Patent No.: US 9,815,183 B2
(45) Date of Patent: Nov. 14, 2017

(54) QUICK DETACHABLE WRENCH STRUCTURE

(71) Applicant: Yeo Ming Wang, Taipei (TW)

(72) Inventor: Yeo Ming Wang, Taipei (TW)

( * ) Notice: Subject to any disclaimer, the term of this patent is extended or adjusted under 35 U.S.C. 154(b) by 360 days.

(21) Appl. No.: 14/592,622

(22) Filed: Jan. 8, 2015

(65) Prior Publication Data

US 2016/0199966 A1 Jul. 14, 2016

(51) Int. Cl.
*B25B 23/00* (2006.01)
*B25B 13/46* (2006.01)

(52) U.S. Cl.
CPC ..... *B25B 23/0057* (2013.01); *B25B 13/463* (2013.01); *B25B 23/0035* (2013.01)

(58) Field of Classification Search
CPC ..... B25B 13/463; B25B 15/04; B25B 13/465; B25B 23/0035; B25B 13/46; B25B 13/461; B25B 23/0057; B25B 21/005
See application file for complete search history.

(56) References Cited

U.S. PATENT DOCUMENTS 4,553,453 A * 11/1985 Dempsey ..... B25B 13/462 403/328
7,111,527 B1 * 9/2006 Lee ..... B25B 23/0035 81/58.1
7,185,566 B2 * 3/2007 Arnold ..... B25B 13/468 81/63
9,038,506 B1 * 5/2015 Huang ..... B25B 13/462 81/60
2012/0210829 A1 * 8/2012 Chang ..... B25B 13/463 81/63.2

* cited by examiner

*Primary Examiner* — Robert Scruggs
(74) *Attorney, Agent, or Firm* — Muncy, Geissler, Olds & Lowe, P.C.

(57) ABSTRACT

A quick detachable wrench structure comprises: a wrench head portion, which has a hollow operation accommodation room and a top end portion disposed at an upper portion thereof; and a pressing member, which has a top pressing portion and a bottom plug portion, the bottom plug portion is embedded in the operation accommodation room, the top pressing portion is disposed at an upper portion of the top end portion, a bottom edge of the bottom plug portion is against to a bottom end of the top end portion in order to avoid the bottom plug portion taking off from the operation accommodation room.

10 Claims, 9 Drawing Sheets

QUICK DETACHABLE WRENCH STRUCTURE

BACKGROUND OF THE INVENTION

1. Field of the Invention

The present invention generally relates to a wrench structure, more particularly to a wrench structure that can rapidly detach from a rotated piece after operations.

2. Description of the Prior Art

Wrench is a regular tool for fastening or loosing working parts, such as bolt, nut, etc. There are many kinds of wrenches, which has open-end wrench, combination wrench, wrench, adjustable wrench, socket wrench, etc. Please refer to FIG. 1, which illustrates a wrench structure in prior arts. The wrench 90 has a wrench head portion 91 with an accommodation room 92. An outer ring portion of the accommodation room 92 has a rotary device 93. An inner surface of the rotary device 93 has a hole on a certain position thereof, and the hole has a spring (not shown in figure) and an urging member 931, such as a steel ball. The urging member 931 is pushed to enter into the accommodation room 92. The accommodation room 92 is able to accommodate a rotated piece 94 as nut, screw rod, etc. The accommodation room 92 and the rotated piece 94 are matched with each other. The rotated piece 94 has a positioning ring slot 941, and the urging member 931 of the rotary device 93 is inwardly protruded to just fit into the positioning ring slot 941 in order to position the rotated piece 94 when the rotated piece 94 enters into the accommodation room 92. Therefore, the rotated piece 94 may not slide from the accommodation room 92, and can be tight or loose. Traditionally, there still exists a disadvantage, for example, when the rotated piece 94 drops out from the accommodation room 92 of the wrench 90, and the rotated piece 94 and the accommodation room 92 are tightened hardly to each other, hence finger is always used to downwardly push the rotated piece 94 in the accommodation room 92 out. Obviously, it is inconvenient to detach the rotated piece 94 from the wrench 90. As it can be seen, to solve the problem of inconvenient detaching process is an important issue for people who is skillful in the art.

Accordingly, the inventor has studied and developed a quick detachable wrench structure, which is able to conveniently, safely and rapidly detach a wrench from a rotated piece.

SUMMARY OF THE INVENTION

The main objective of the present invention is to provide a quick detachable wrench structure, which is a simple structure and is able to rapidly detach a wrench from a rotated piece, such as nut, screw rod, etc. for operations with convenience and safety.

The second objective of the present invention is to provide the quick detachable wrench structure, which has a pressing member with a function of automatic press-to-recover for following operations, so as to increase practicability and value-added.

To approach aforesaid objectives, the quick detachable wrench structure comprises: a wrench head portion, which has a hollow operation accommodation room and a top end portion disposed at an upper portion thereof; and a pressing member, which has a top pressing portion and a bottom plug portion, the bottom plug portion is embedded in the operation accommodation room, the top pressing portion is disposed at an upper portion of the top end portion, a bottom edge of the bottom plug portion is propped against a bottom end of the top end portion in order to prevent the bottom plug portion from taking off from the operation accommodation room.

Accordingly, the peripheral walls of the operation accommodation room are selected from the group consisting of: curved surfaces, cambered surfaces and straight surfaces.

Accordingly, the top end portion is circularly elongated to form a top protruding portion toward the center of the operation accommodation room, and the top protruding portion forms an urging ring space beyond the operation accommodation room.

Accordingly, the pressing member has a central channel space.

Accordingly, a bottom edge of the bottom plug portion is disposed at a positioning groove, a ring member is embedded in the positioning groove.

Accordingly, the quick detachable wrench structure further comprises: a ratchet, which is disposed in the operation accommodation room and is a hollow ring member with an operation space, the ratchet has an outer ring teeth portion and an inner rotational surface that has a hole, wherein a spring and an urging member are in the hole; a reversing switch, which is disposed in a pivotal slot which is located at a rear end portion of the wrench head portion, and is connected with the ratchet for moving;

a support ring member, which is disposed in the operation accommodation room and is female-connected with a lower portion of the ring teeth portion of the ratchet, so as to support the ratchet; and a positioning member, which is embedded in a ring slot where is at a lower portion of the operation accommodation room so as to urge the support ring member, and is a positioning stop for the entire operation accommodation room.

Accordingly, the quick detachable wrench structure further comprises a flexible member between the top end portion and the top pressing portion.

Accordingly, the flexible member has a through hole disposed in a central portion thereof and a protruding portion for a press-to-recover force.

Accordingly, a bottom edge of the bottom plug portion is disposed one positioning hook or a plurality of positioning hooks averagely distributed on the bottom plug portion.

Accordingly, the bottom plug portion has a plurality of vertical notches, and each of the notches cuts through the bottom plug portion and the positioning hook.

Accordingly, the quick detachable wrench structure further comprises a press-to-position member, wherein the press-to-position member has a connecting part at an upper portion thereof and an urging part at a lower portion thereof, the connecting part is connected with the bottom plug portion, the urging part is propped against a bottom end of the top protruding portion or the top end portion.

Accordingly, the connecting part and the bottom plug portion are connected with each other by means of snapping or screwing.

BRIEF DESCRIPTION OF THE DRAWINGS

The objectives, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objectives.

Figure 1:
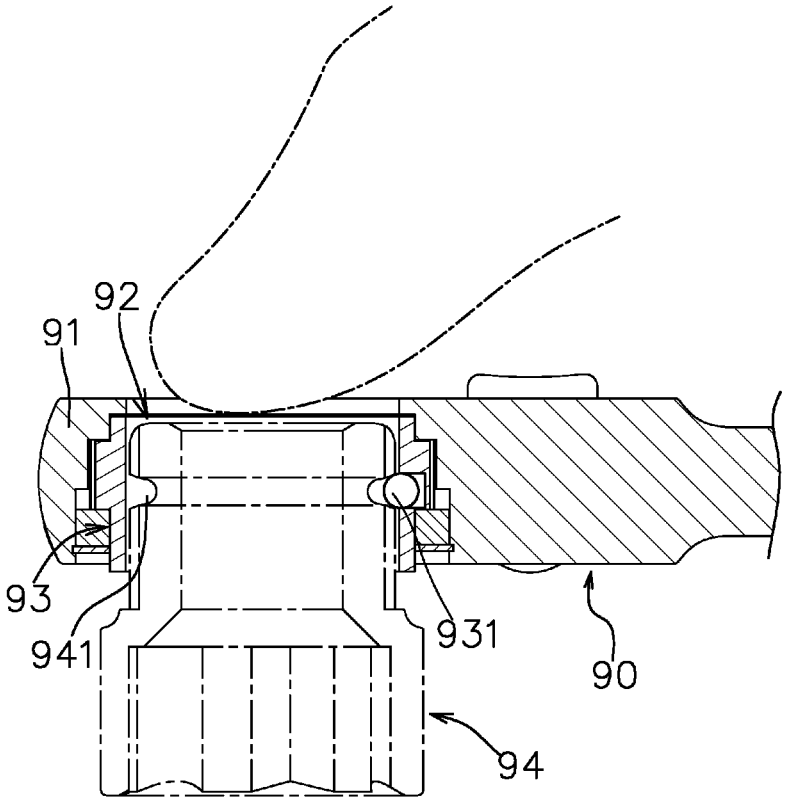
FIG. 1 (Prior Art)
FIG. 1 illustrates a schematic view of a wrench in prior arts.
Figure 2:
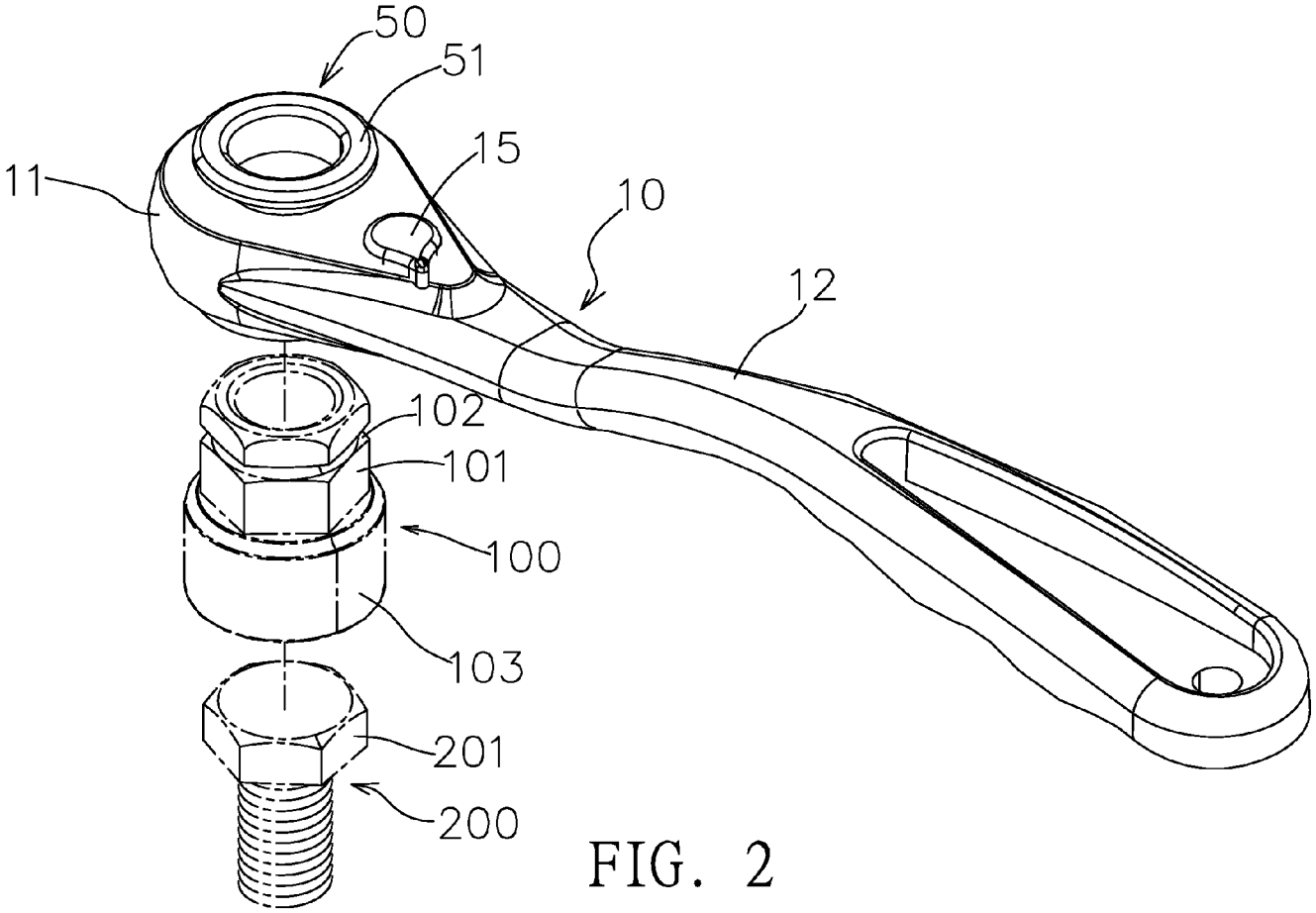
FIG. 2 illustrates a schematic perspective view of a first preferred embodiment of the present invention.
Figure 3:
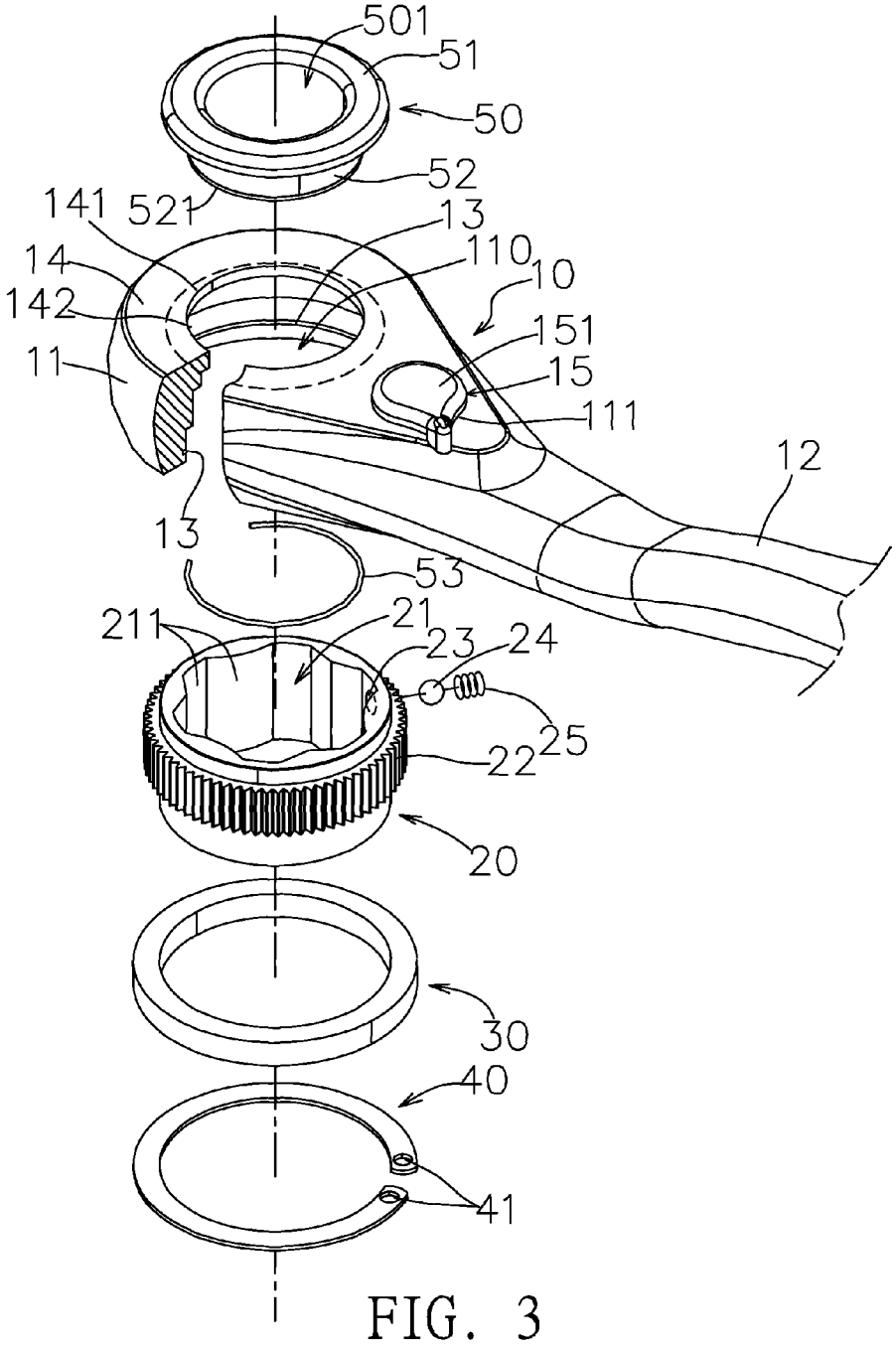
FIG. 3 illustrates a schematic exploded view of the first preferred embodiment of the present invention.

Please refer to FIG. 2 and FIG. 3, which illustrate a first preferred embodiment of the quick detachable wrench structure of the present invention. As shown in the figures, the quick detachable wrench structure 10 has: a wrench head portion 11 and a wrench handle 12. The wrench head portion 11 has a hollow operation accommodation room 110, and the peripheral walls of the operation accommodation room 110 are curved surfaces, cambered surfaces, straight surfaces, etc., but not limited thereto. The operation accommodation room 110 has a ring slot 13 at ex. a bottom edge thereof. A top end portion 14 is disposed at an upper portion of the wrench head portion 11. The top end portion 14 is circularly elongated to form a top protruding portion 141 toward the center of the operation accommodation room 110, and the top protruding portion 141 forms an urging ring space 142 beyond and internally elongated from the operation accommodation room 110. The urging ring space 142 is an urging limit at an upper portion of the operation accommodation room 110. The top end portion 14 is possibly a part of a top end of the wrench head portion 11, that is, the wrench head portion 11 is elongated by integration to form the top protruding portion 141 and the urging ring space 142.

The first preferred embodiment of the present invention further comprises a pressing member 50 that is about a ring plug member. The pressing member 50 has a central channel space 501, a top pressing portion 51 around the central channel space 501 and a bottom plug portion 52. A bottom edge of the bottom plug portion 52 is disposed with a positioning groove 521, a ring member 53 is embedded in the positioning groove 521. Please refer to FIG. 4 simultaneously, for assembling the pressing member 50, the bottom plug portion 52 is inserted into the operation accommodation room 110 via the urging ring space 142, the ring member 53 is embedded in the positioning groove 521, so that the top pressing portion 51 goes beyond the top protruding portion 141 of the top end portion 14. The bottom plug portion 52 is propped against the bottom end of the top protruding portion 141 of the top end portion 14 by means of the positioning groove 521, so as to prevent the bottom plug portion 52 of the pressing member 50 from taking off upwardly.

For the pressing member 50 assembling to the quick detachable wrench structure 10, to press the pressing member 50 is able to downwardly force a sleeve/screwed piece 100 disposed in the operation accommodation room 110, so as to rapidly move the sleeve/screwed piece 100 out from the operation accommodation room 110 and detach the sleeve/screwed piece 100 from the quick detachable wrench structure 10. Since the central channel space 501 serves as a positioning piece for screw rod to go through, the pressing member 50 may not have the central channel space 501. Therefore, the central channel space 501 is unnecessary to the top pressing portion 51 or the bottom plug portion 52. Obviously, it is easier to operate the pressing member 50.

Further, as shown in figure, the present embodiment is described according to a ratchet wrench structure. The embodiment further comprises: a ratchet 20, which is a hollow ring member with an operation space 21, and has an outer ring teeth portion 22 and an inner rotational surface 211, wherein the inner rotational surface 211 is a curved surface, a cambered surface, a straight surface, etc., but not limited thereto, the ratchet 20 is disposed in the operation accommodation room 110 of the wrench head portion 11 and has a hole 23 at a certain position of the inner rotational surface 211, wherein the hole 23 has a spring 25 and an urging member 24, wherein the urging member 24 can be a steel ball, and is urged by the spring 25 in order to extend into the operation accommodation room 100, further, a pivotal slot 111 of the wrench head portion 11 is adjacent to the wrench handle 12 that is at a rear end portion of the wrench head portion 11, a reversing switch 15 is disposed there as well, wherein a wrench member 151 is disposed on the reversing switch 15, and the reversing switch 15 is connected with the ratchet 20 for moving; a support ring member 30, which is disposed in the operation accommodation room 110 and is female-connected with a lower portion of the ring teeth portion 22 of the ratchet 20, so as to support the ratchet 20; a positioning member 40, which is a C-typed member and is embedded in a ring slot 13 which is located at a lower portion of the operation accommodation room 110 so as to urge the support ring member 30, and is a positioning stop for the entire operation accommodation room 110; each of two ring ends of the positioning member 40 has a through hole 41 in order to be convenient for positioning and moving operations.

Figure 4:
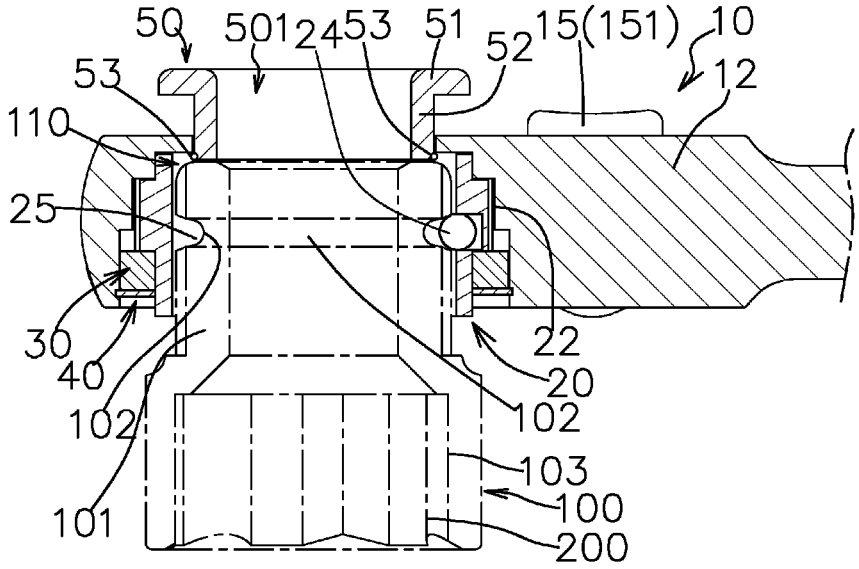
FIG. 4 illustrates a schematic operation sectional view I of the first preferred embodiment of the present invention.
Figure 4A:
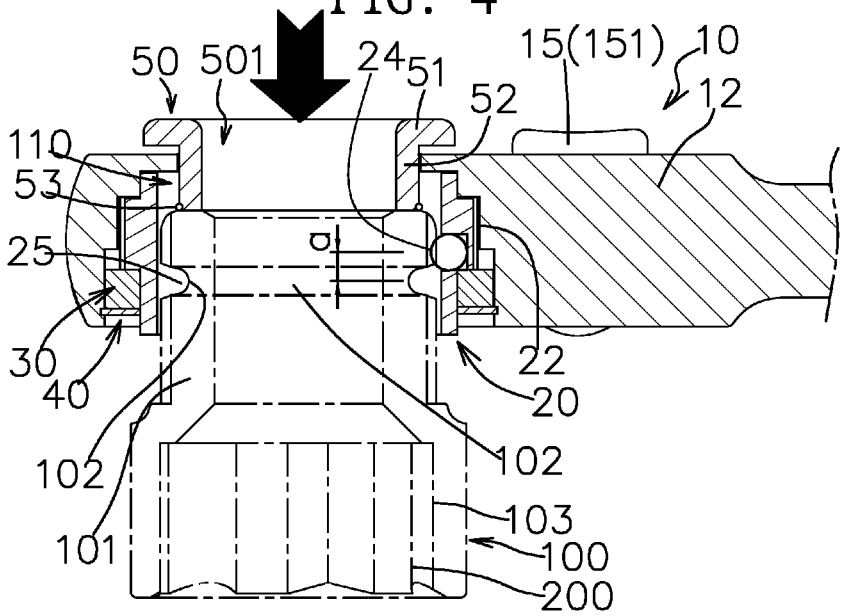
FIG. 4*a* illustrates a schematic operation sectional view II of the first preferred embodiment of the present invention.

Please refer to FIG. 2, FIG. 4 and FIG. 4*a*. In order to operate the quick detachable wrench structure, the operation accommodation room 110 of the wrench structure 10 firstly female-connects with a sleeve head portion 101 of the sleeve/screwed piece 100, wherein the sleeve head portion 101 has a positioning ring slot 102. Secondly, the pressing member 50 is upwardly pushed. The inwardly protruding urging member 24 just embeds into the positioning ring slot 102 for positioning the sleeve head portion 101. Continuously, a screw rod 200 as positioning piece operates in order to female-connect the screw rod 200 with an accommodation portion 103 of the sleeve/screwed piece 100.

Further, the top pressing portion 51 of the pressing member 50 is continuously pushed, and this makes that the bottom plug portion 52 of the pressing member 50 keeps thrusting the sleeve head portion 101 of the sleeve 100. So that the positioning ring slot 102 is not propped against by the protruding urging member 24. Accordingly, based on the pressing member 50, the sleeve head portion 101 of the sleeve/screwed piece 100 moves a distance, as shown in FIG. 4*a*. Hence, the sleeve head portion 101 of the sleeve/screwed piece 100 may not be restricted and automatically drop down because of gravity. As it can be seen, it is very convenient for taking the sleeve head portion 101 apart.

Figure 5:
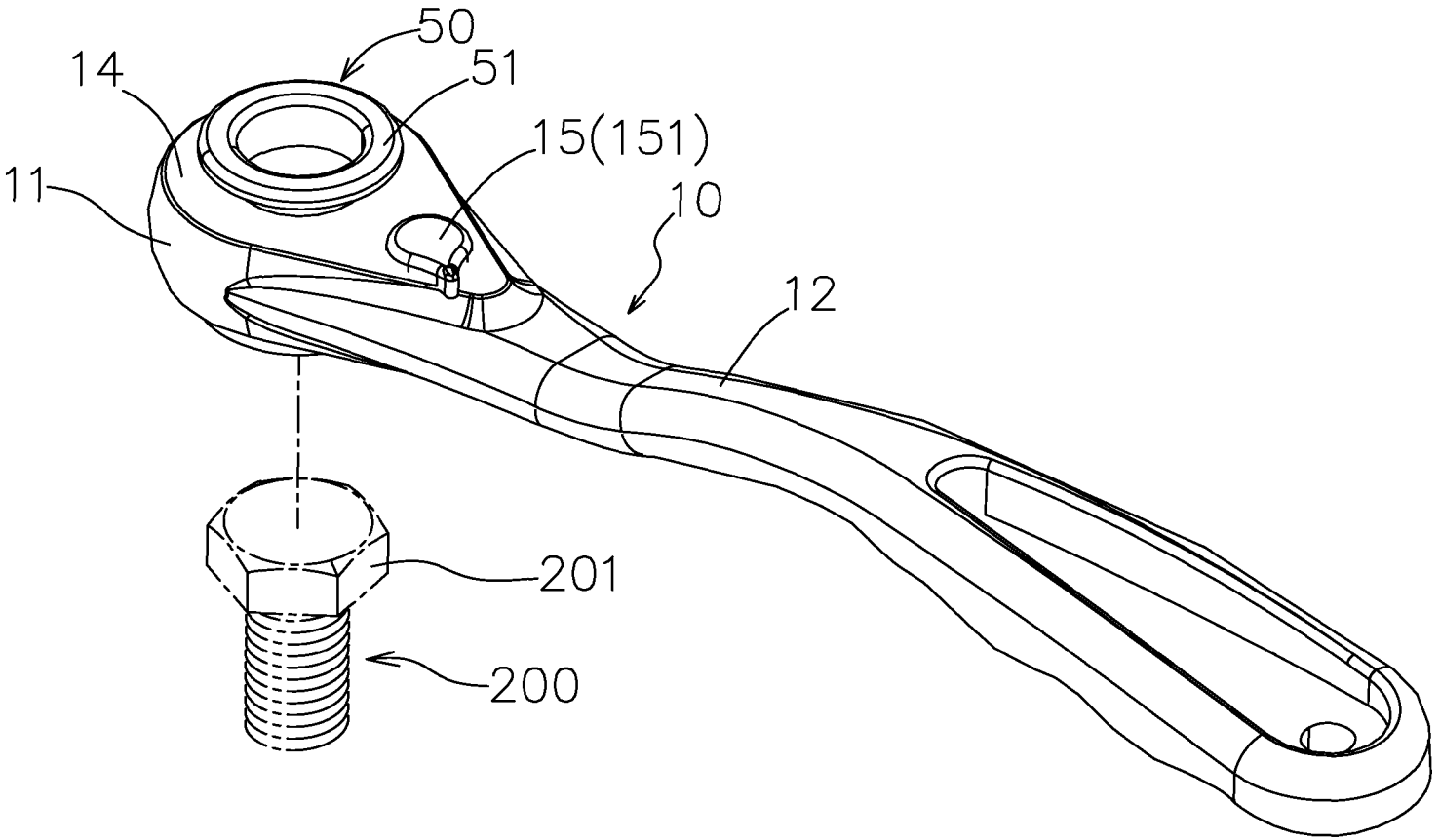
FIG. 5 illustrates a schematic view of another application of the first preferred embodiment of the present invention.
Figure 6:
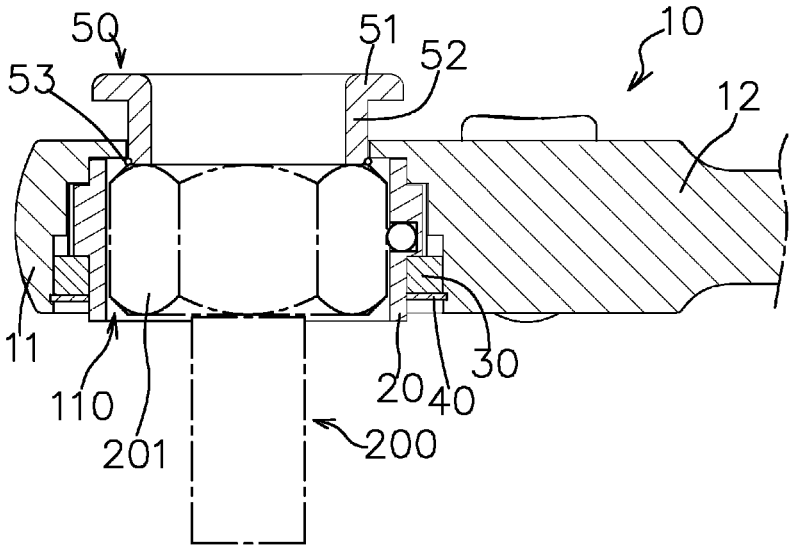
FIG. 6 illustrates a schematic operation sectional view I of the application of the first preferred embodiment of the present invention.
Figure 6A:
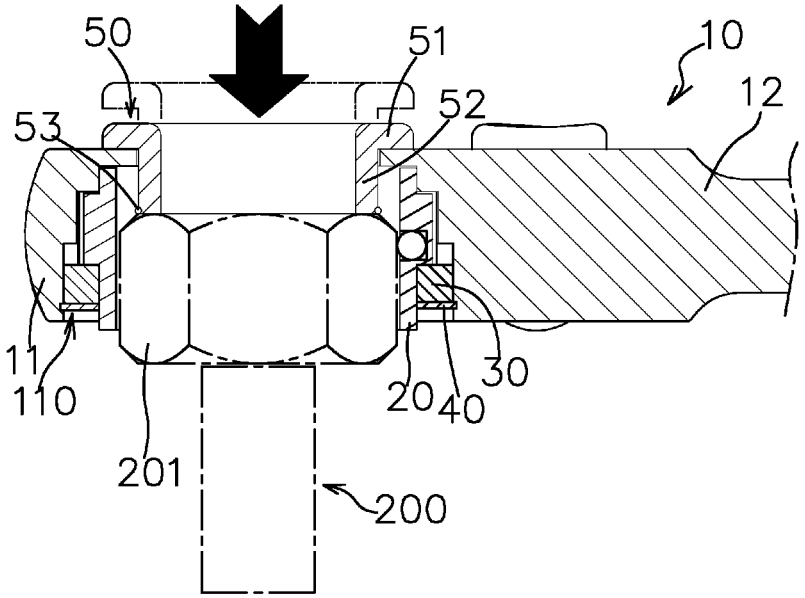
FIG. 6*a* illustrates a schematic operation sectional view II of the application of the first preferred embodiment of the present invention.

Please refer to FIG. 5, FIG. 6 and FIG. 6*a*, which illustrate a schematic view of another application of the first preferred embodiment of the present invention, a schematic operation sectional view I of the application of the first preferred embodiment of the present invention and a schematic operation sectional view II of the application of the first preferred embodiment of the present invention. The differences between the application shown in FIG. 5, FIG. 6 and FIG. 6*a* and the application shown in FIG. 4 and FIG. 4*a* are described as follows. The wrench structure 10 directly screws the screw rod 200 (screwed piece/positioning piece). That is, a screw head 201 of the screw rod 200 is accommodated into the operation accommodation room 110 of the wrench structure 10. Continuously, the top pressing portion 51 of the pressing member 50 is continuously pushed, and this makes that the bottom plug portion 52 of the pressing member 50 keeps thrusting a screw head portion 201 of the screw rod 200; relatively, the wrench head portion 11 is withdrawn in order to release the wrench structure 10 or slightly loose the screw rod 200, hence the wrench structure 10 is easily detached.

Figure 7:
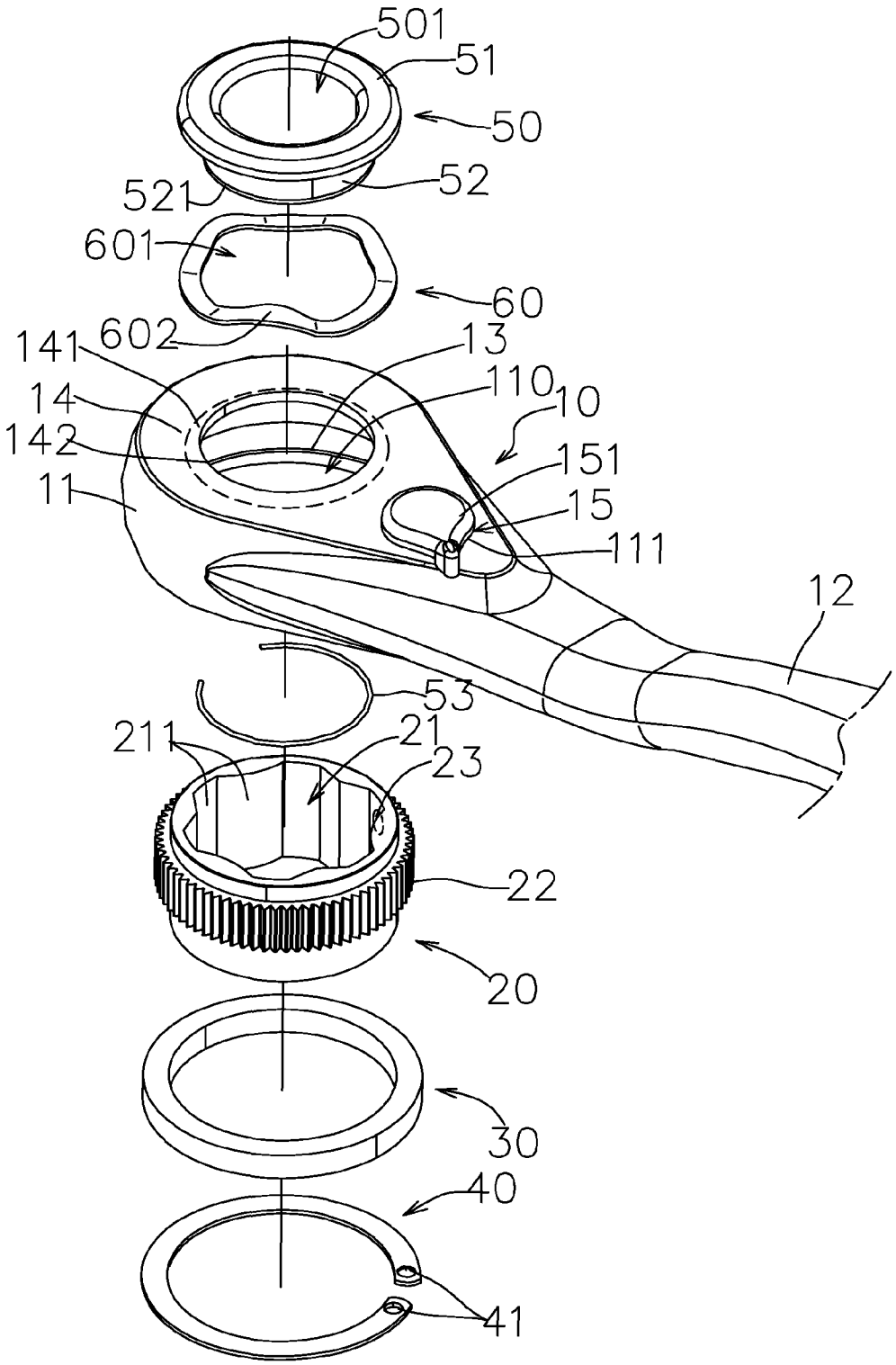
FIG. 7 illustrates a schematic exploded view of a second preferred embodiment of the present invention.

Please refer to FIG. 7, which illustrates a second preferred embodiment of the quick detachable wrench structure of the present invention. The second preferred embodiment is a little different than the first preferred embodiment. The differences between the first and second preferred embodiment are described as follows. The second preferred embodiment further comprises a flexible member 60, and the flexible member 60 is a spring piece or other patterns. More, the flexible member 60 has a through hole 601 disposed in a central portion thereof and a protruding portion 602 for a press-to-recover force. The flexible member 60 is disposed on the top protruding portion 141 of the top end portion 14 of the wrench head portion 11 according to the direction of figure; or the flexible member 60 is disposed a position beneath the top pressing portion 51 of the pressing member 50, so that the flexible member 60 is between the top protruding portion 141 of the top end portion 14 of the wrench head portion 11 and the top pressing portion 51 of the pressing member 50. When the top pressing portion 51 of the pressing member 50 pressing a rotated piece (or a positioned piece), the flexible member 60 is thrust by the pressing member 50; if the moment of the pressing member 50 is not working, a press-to-recover force from the flexible member 60 is able to urge the pressing member 50 up, so as to let the pressing member 50 be back to original status.

Figure 8:
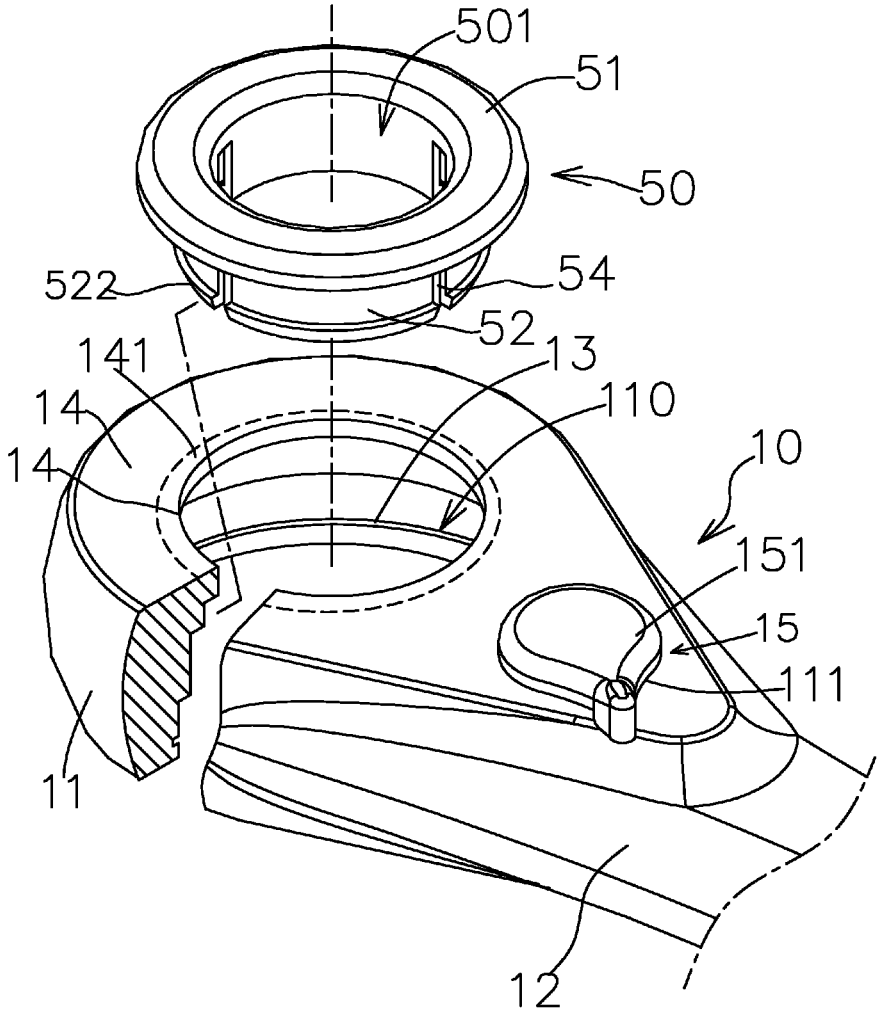
FIG. 8 illustrates a schematic exploded view of a third preferred embodiment of the present invention.

Please refer to FIG. 8, which illustrates a third preferred embodiment of the quick detachable wrench structure of the present invention. The third preferred embodiment is a little different than the first preferred embodiment. The differences between the first and third preferred embodiment are described as follows. A bottom edge of the bottom plug portion 52 is disposed one positioning hook 522 or a plurality of positioning hooks 522 averagely distributed on the bottom plug portion 52. The bottom plug portion 52 is instead of the positioning groove 521 and the ring member 53. The bottom plug portion 52 has a plurality of vertical notches 54 (parallel to the central channel space 501), and each of the notches 54 downwardly cuts through the bottom plug portion 52 and the positioning hook 522 according to the direction of figure. So that the plurality of the bottom plug portion 52 and the positioning hook 522 are circularly distributed. When the pressing member 50 is assembled into the operation accommodation room 110, the positioning hook 522 is against to the bottom end of the top protruding portion 141 in order to prevent that the bottom plug portion 52 of the pressing member 50 upwardly takes off. Squeeze forces from the notches 54 may stable the pressing member 50.

Figure 9:
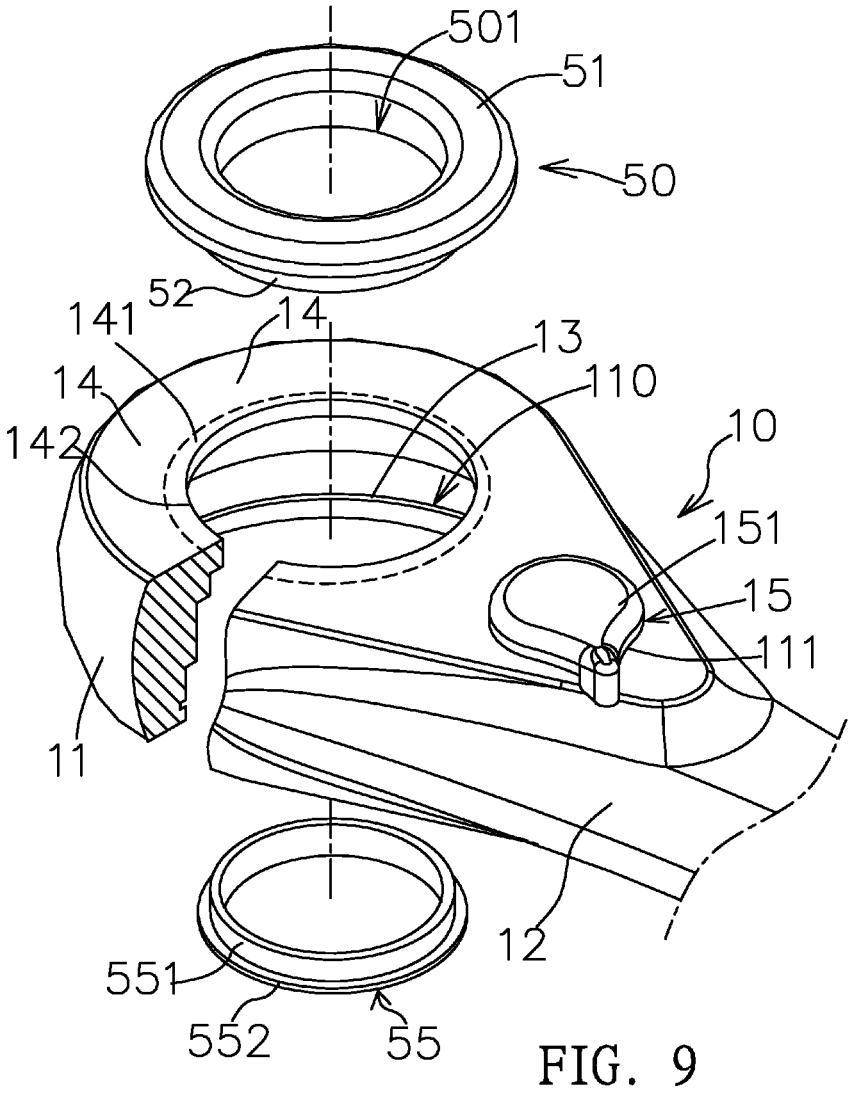
FIG. 9 illustrates a schematic exploded view of a fourth preferred embodiment of the present invention.

Please refer to FIG. 9, which illustrates a fourth preferred embodiment of the quick detachable wrench structure of the present invention. The third preferred embodiment is a little different than the first preferred embodiment. The differences between the first and third preferred embodiment are described as follows. The bottom of the pressing member 50 is connected with a press-to-position member 55, which has a connecting part 551 at an upper portion thereof and an urging part 552 at a lower portion thereof. When in assembly, the press-to-position member 55 upwardly enters into the operation accommodation room 110, so as to integrate the connecting part 551 and the bottom plug portion 52, and therefore the urging part 552 is against to the bottom end of the top protruding portion 141 of the top end portion 14 in order to prevent that the bottom plug portion 52 of the pressing member 50 takes off upwardly. The fourth preferred embodiment adopts the press-to-position member 55 to replace the positioning groove 521 and the ring member 53 in FIG. 3. More, the connecting part 551 and the bottom plug portion 52 are connected with each other by means of snap or screwing for more stability.

The quick detachable wrench structure is able to rapidly detach a wrench from a rotated piece as bolt, nut, etc., so as to create convenience and safety. Another value-added is that the pressing member is with the advantage of press-to-recover for following operations.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A quick detachable wrench structure, comprising:

a wrench head portion, having a hollow operation accommodation room and a top end portion disposed at an upper portion thereof;

a pressing member, having a top pressing portion and a bottom plug portion, the bottom plug portion being embedded in the operation accommodation room, the top pressing portion being disposed at an upper portion of the top end portion, a bottom edge of the bottom plug portion being against to a bottom end of the top end portion in order to avoid the bottom plug portion taking off from the operation accommodation room;

a ratchet, being disposed in the operation accommodation room and being a hollow ring member with an operation space, having an outer ring teeth portion and an inner rotational surface that has a hole, wherein a spring and an urging member are in the hole;

a reversing switch, being disposed in a pivotal slot where is at a rear end portion of the wrench head portion, and being connected with the ratchet for moving;

a support ring member, being disposed in the operation accommodation room and being female-connected with a lower portion of the ring teeth portion of the ratchet, so as to support the ratchet; and a positioning member, being embedded in a ring slot where is at a lower portion of the operation accommodation room so as to urge the support ring member, and being a positioning stop for the entire operation accommodation room, wherein a bottom edge of the bottom plug portion is disposed a positioning groove, a ring member is embedded in the positioning groove.

2. The quick detachable wrench structure according to claim 1, wherein the peripheral walls of the operation accommodation room are selected from the group consisting of: curved surfaces, cambered surfaces and straight surfaces.

3. The quick detachable wrench structure according to claim 1, wherein the top end portion is circularly elongated to form a top protruding portion toward the center of the operation accommodation room, and the top protruding portion forms an urging ring space beyond the operation accommodation room.

4. The quick detachable wrench structure according to claim 1, wherein the pressing member has a central channel space.

5. The quick detachable wrench structure according to claim 1 further comprising a flexible member where is between the top end portion and the top pressing portion.

6. The quick detachable wrench structure according to claim 5, wherein the flexible member has a through hole disposed in a central portion thereof and at least one protruding portion for a press-to-recover force.

7. The quick detachable wrench structure according to claim 1, wherein a bottom edge of the bottom plug portion is disposed one positioning hook or a plurality of positioning hooks averagely distributed on the bottom plug portion.

8. The quick detachable wrench structure according to claim 7, wherein the bottom plug portion has a plurality of vertical notches, and each of the notches cuts through the bottom plug portion and a positioning hook of the plurality of positioning hooks.

9. The quick detachable wrench structure according to claim 1 further comprising a press-to-position member, wherein the press-to-position member has a connecting part at an upper portion thereof and an urging part at a lower portion thereof, the connecting part being connected with the bottom plug portion, the urging part being against to a bottom end of the top protruding portion or the top end portion.

10. The quick detachable wrench structure according to claim 9, wherein the connecting part and the bottom plug portion are connected with each other by means of snapping or screwing.

* * * * *